US009175627B2

(12) United States Patent
Nose et al.

(10) Patent No.: US 9,175,627 B2
(45) Date of Patent: Nov. 3, 2015

(54) FUEL INJECTION CONTROL APPARATUS FOR AN INTERNAL COMBUSTION ENGINE

(75) Inventors: Hiroyuki Nose, Ebina (JP); Satoshi Nishii, Kawasaki (JP); Manabu Okamura, Isehara (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 828 days.

(21) Appl. No.: 13/417,796

(22) Filed: Mar. 12, 2012

(65) Prior Publication Data

US 2012/0298085 A1 Nov. 29, 2012

(30) Foreign Application Priority Data

May 24, 2011 (JP) ..... 2011-115981
Jan. 11, 2012 (JP) ..... 2012-003535

(51) Int. Cl.

| | |
|---|---|
| ***F02D 41/00*** | (2006.01) |
| ***F02D 41/04*** | (2006.01) |
| ***F02D 41/02*** | (2006.01) |
| *F02D 41/12* | (2006.01) |
| *F02D 41/14* | (2006.01) |
| *F02N 11/08* | (2006.01) |

(52) U.S. Cl.

CPC ..... *F02D 41/047* (2013.01); *F02D 41/0235* (2013.01); *F02D 41/123* (2013.01); *F02D 41/1446* (2013.01); *F02D 41/1456* (2013.01); *F02D 2200/0804* (2013.01); *F02N 11/0814* (2013.01)

(58) Field of Classification Search

CPC . F02D 41/047; F02D 41/126; F02D 41/0235; F02D 41/123; F02D 41/1446; F02D 41/1456; F02D 2200/0804; F02N 11/0814

USPC ..... 123/481, 676, 699; 701/112, 113, 103, 701/104

See application file for complete search history.

(56) References Cited

U.S. PATENT DOCUMENTS 5,762,043 A * 6/1998 Yoshioka et al. ..... 123/325
5,983,630 A * 11/1999 Kibe et al. ..... 60/285

(Continued)

FOREIGN PATENT DOCUMENTS

CN 1441157 9/2003
CN 101124392 2/2008

(Continued)

*Primary Examiner* — Hai Huynh
*Assistant Examiner* — Raza Najmuddin
(74) *Attorney, Agent, or Firm* — Drinker Biddle & Reath LLP

(57) ABSTRACT

A fuel injection control apparatus for controlling an amount of fuel injection into a fuel injection port of an intake passage in an internal combustion engine, the fuel injection control apparatus including an exhaust air-fuel ratio sensor configured to detect an exhaust air-fuel ratio, an exhaust temperature sensor configured to detect an exhaust temperature, an intake air flow meter configured to detect an intake air amount in the intake passage, and a controller configured to estimate a wall flow amount of the fuel injection port based on the fuel injection amount, the exhaust air-fuel ratio, and the intake air amount, estimate a catalyst bed temperature of a catalyst provided in an exhaust passage based on the exhaust air-fuel ratio and the exhaust temperature and to correct the estimated catalyst bed temperature in accordance with the wall flow amount, and control the fuel injection amount based on the catalyst bed temperature.

14 Claims, 8 Drawing Sheets

(56) References Cited

U.S. PATENT DOCUMENTS

| | | | | |
|---|---|---|---|---|
| 7,228,221 | B2 * | 6/2007 | Niimi | 701/104 |
| 7,412,821 | B2 * | 8/2008 | Araki et al. | 60/284 |
| 2003/0163243 | A1 | 8/2003 | Inoue | |
| 2004/0181331 | A1 * | 9/2004 | Nagaishi et al. | 701/104 |
| 2006/0207241 | A1 * | 9/2006 | Araki et al. | 60/284 |
| 2010/0126146 | A1 * | 5/2010 | Yamamoto | 60/286 |
| 2011/0192380 | A1 * | 8/2011 | Tomimatsu et al. | 123/493 |

FOREIGN PATENT DOCUMENTS

| | | | |
|---|---|---|---|
| CN | 101657618 | A | 2/2010 |
| EP | 1 515 015 | | 3/2005 |
| EP | 1 947 306 | A1 | 7/2008 |
| JP | H07-166922 | A | 6/1995 |
| JP | H11-14507 | A | 1/1999 |
| JP | 2002-089331 | A | 3/2002 |
| JP | 2002-206444 | | 7/2002 |
| JP | 2002-213276 | A | 7/2002 |
| JP | 2003-254118 | A | 9/2003 |
| JP | 2003-322051 | | 11/2003 |
| JP | 2004-60563 | | 2/2004 |
| JP | 2005-048712 | | 2/2005 |
| JP | 2005-188293 | A | 7/2005 |
| JP | 2007-168471 | A | 7/2007 |
| JP | 2010-270669 | A | 12/2010 |
| JP | 2011-099337 | A | 5/2011 |

* cited by examiner

FUEL INJECTION CONTROL APPARATUS FOR AN INTERNAL COMBUSTION ENGINE

CROSS-REFERENCE TO RELATED APPLICATIONS

This application claims priority under 35 U.S.C. §119 to Japanese Patent Application No. 2011-115981, filed on May 24, 2011, and Japanese Patent Application No. 2012-003535, filed on Jan. 11, 2012, each of which is incorporated by reference herein in its entirety.

BACKGROUND OF THE INVENTION

1. Field of Invention

The present invention relates to fuel injection control apparatuses for an internal combustion engine.

2. Description of Related Art

In existing systems, in order to suppress overheating of a catalyst bed temperature ("bed temperature") of an exhaust converting catalyst depending on an operation state of an internal combustion engine, fuel injection amount is increased based not only on an amount of heat supplied to the catalyst from exhaust gas but also on an amount of heat generated due to the catalytic reaction.

However, at the time of fuel cut control or a rapid decrease in intake air amount, the fuel adhering to the wall surfaces of a fuel injection port of an intake passage ("wall flow") may flow into the catalyst in an unburned state. As a result, estimation accuracy of the catalyst bed temperature may decrease, or the catalyst bed temperature may become excessively high, depending on the wall flow amount.

An object of the present invention is to provide a fuel injection control apparatus for an internal combustion engine which is capable of accurately estimating the catalyst bed temperature even when the wall flow amount of the fuel injection port fluctuates, or of preventing overheating of the catalyst bed temperature.

SUMMARY OF THE INVENTION

According to an embodiment of the present invention, an accurate estimate of the catalyst bed temperature can be achieved by estimating a wall flow amount of a fuel injection port, determining the amount of heat due to the catalytic reaction based on the estimated wall flow amount, and correcting the catalyst bed temperature. Alternatively, overheating of the catalyst bed can be prevented by performing a fuel increase based on the estimated wall flow amount upon a fuel cut control or a rapid decrease in intake air amount.

According to an embodiment of the present invention, the amount of heat generated by the catalyst reaction, hence the catalyst bed temperature, is determined in consideration of the wall flow amount of the fuel injection port, so that the accuracy of estimation of the catalyst bed temperature is improved. Further, fuel increase is performed upon fuel cut control or a rapid decrease in intake air amount in consideration of the wall flow amount of the fuel injection port, so that the catalyst bed temperature is prevented from becoming excessively high.

In one embodiment, a fuel injection control apparatus is described for controlling an amount of fuel injection into a fuel injection port of an intake passage in an internal combustion engine. The fuel injection control apparatus includes an exhaust air-fuel ratio sensor configured to detect an exhaust air-fuel ratio, an exhaust temperature sensor configured to detect an exhaust temperature, an intake air flow meter configured to detect an intake air amount in the intake passage, and a controller. The controller is configured to estimate a wall flow amount of the fuel injection port based on the fuel injection amount, the detected exhaust air-fuel ratio, and the detected intake air amount, to estimate a catalyst bed temperature of a catalyst provided in an exhaust passage based on the detected exhaust air-fuel ratio and the detected exhaust temperature and to correct the estimated catalyst bed temperature in accordance with the wall flow amount, and to control the fuel injection amount based on the catalyst bed temperature.

In another embodiment, a fuel injection control apparatus is described for controlling an amount of fuel injection into a fuel injection port of an intake passage in an internal combustion engine. The fuel injection control apparatus includes an exhaust air-fuel ratio sensor configured to detect an exhaust air-fuel ratio, an intake air flow meter configured to detect an intake air amount in the intake passage, and a controller. The controller is configured to estimate a wall flow amount of the fuel injection port based on the fuel injection amount, the detected exhaust air-fuel ratio, and the detected intake air amount, and to correct the fuel injection amount to be increased when the wall flow amount is larger than a predetermined value upon sharp decrease in an intake air amount.

In another embodiment, a fuel injection control apparatus is described for controlling an amount of fuel injection into a fuel injection port of an intake passage in an internal combustion engine. The fuel injection control apparatus includes an exhaust air-fuel ratio sensor configured to detect an exhaust air-fuel ratio, an intake air flow meter configured to detect an intake air amount in the intake passage, and a controller. The controller is configured to estimate a wall flow amount of the fuel injection port based on the fuel injection amount, the detected exhaust air-fuel ratio, and the detected intake air amount, and to prohibit a fuel cut and correct the fuel injection amount to be increased when the wall flow amount is larger than a predetermined value upon satisfaction of a predetermined fuel cut condition.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

In the following, an explanation of an embodiment according to the present invention will be made with reference to accompanying drawings.

Figure 1:
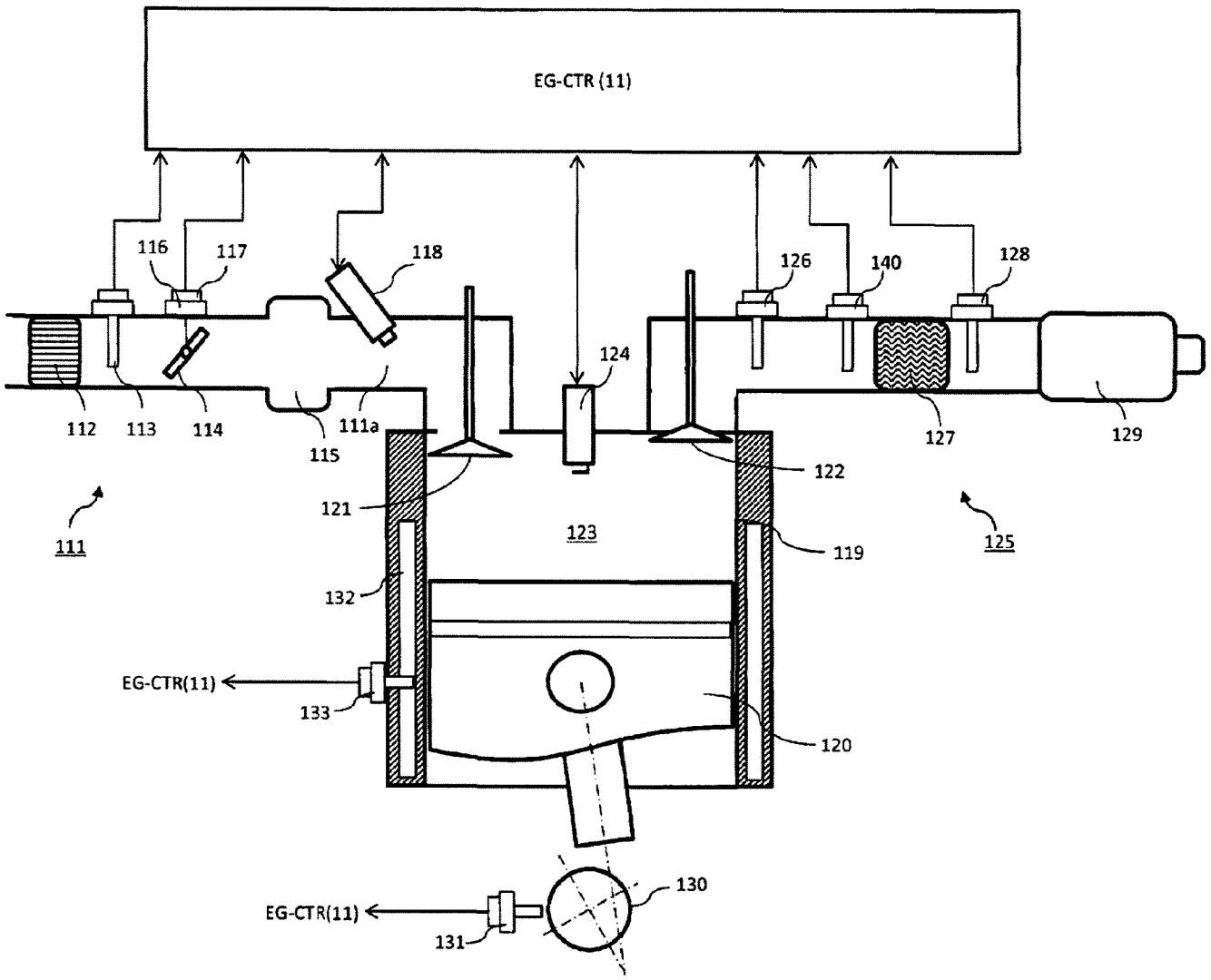
FIG. 1 is a block diagram of an internal combustion engine according to an embodiment of the present invention.

FIG. 1 is a block diagram of an internal combustion engine according to an embodiment of the present invention, illustrating an example in which a fuel injection control apparatus is applied to a spark-ignited engine EG.

In FIG. 1, the engine EG includes an intake passage 111 provided with an air filter 112, an airflow meter 113 for detecting an intake air flow rate, a throttle valve 114 for controlling an intake air flow rate, and a manifold or collector 115.

The throttle valve 114 is provided with an actuator 116 which may include a DC motor for adjusting the position of the throttle valve 114. The throttle valve actuator 116 electrically controls the position of the throttle valve 114 based on a drive signal from an engine control unit 11 so as to achieve a desired torque which is calculable on the basis of an amount of accelerator pedal operation by the driver. A throttle sensor 117 detects the position of the throttle valve 114 and outputs a detection signal to the engine control unit 11. The throttle sensor 117 may also function as an idle switch.

A fuel injection valve 118 is disposed protruding into a fuel injection port 111*a* of the intake passage 111 that is branched from the collector 115 into an individual cylinder 119 of the engine EG. The fuel injection valve 118 is driven to open in response to a drive pulse signal set in the engine control unit 11 so as to inject fuel into the fuel injection port 111*a*. The injected fuel is pumped from an external fuel pump (not shown) and has a predetermined pressure controlled by a pressure regulator. In accordance with the present embodiment, in order to prevent overheating of the catalyst bed temperature of an exhaust converting catalyst, control is performed such that fuel is increased when the catalyst bed temperature is increased so as to decrease the catalyst bed temperature. Such fuel increasing control is described in detail later.

A space enclosed by a cylinder 119, the crown of a piston 120 that reciprocates in the cylinder 119, and a cylinder head (not numbered) fitted with an intake valve 121 and an exhaust valve 122 provides a combustion chamber 123. A spark plug 124 is attached to protrude into the combustion chamber 123 of each cylinder and ignites an intake mixture gas based on an ignition signal from the engine control unit 11.

On the exhaust side of the engine EG, in an exhaust passage 125, there is provided an air-fuel ratio sensor 126 that detects an air-fuel ratio of exhaust gas by detecting a specific component of the exhaust gas, such as the oxygen concentration thereof. The air-fuel ratio of the exhaust gas can be used to infer the intake mixture gas (intake air-fuel ratio) provided to the cylinder 119. The air-fuel ratio sensor 126 outputs a detection signal to the engine control unit 11. The air-fuel ratio sensor 126 may include an oxygen sensor that produces a rich/lean output, or a wide-range air-fuel ratio sensor that detects the air-fuel ratio linearly over a wide range.

The exhaust passage 125 is also provided with an exhaust converting catalyst 127 for converting the exhaust gas. The exhaust converting catalyst 127 may include a three-way catalyst capable of converting the exhaust gas by oxidizing carbon monoxide CO and hydrocarbon HC in the exhaust gas in the vicinity of stoichiometry (theoretical air-fuel ratio, $\lambda=1$, air weight/fuel weight=14.7), and reducing nitrogen oxide NOx, or an oxidizing catalyst for oxidizing carbon monoxide CO and hydrocarbon HC in the exhaust gas.

Downstream of the exhaust converting catalyst 127 in the exhaust passage 125 is disposed an oxygen sensor 128 for detecting a specific component of the exhaust gas, such as the oxygen concentration thereof and for producing a rich/lean output whose detection signal is outputted to the engine control unit 11. In the illustrated example, an air-fuel ratio feedback control based on a detection value from the air-fuel ratio sensor 126 is corrected in accordance with a detection value from the oxygen sensor 128. In other words, the downstream-side oxygen sensor 128 is provided in order to suppress control errors due to, for example, degrading of the exhaust converting catalyst 127 (i.e., so as to adopt the so-called "double air-fuel ratio sensor system."). However, in the case where the air-fuel ratio feedback control may simply be performed based on the detection value from the air-fuel ratio sensor 126, the oxygen sensor 128 does not have to be provided.

In the vicinity of an inlet to the exhaust converting catalyst 127 in the exhaust passage 125, an exhaust temperature sensor 140 for detecting an exhaust temperature is disposed. A detection signal from the exhaust temperature sensor 140 is outputted to the engine control unit 11. A catalyst bed temperature of the exhaust converting catalyst 127 is estimated according to a predetermined calculation expression set in the engine control unit 11, based on an inlet temperature detected by the exhaust temperature sensor 140, the calculated catalyst reaction heat according to the air-fuel ratio in the exhaust gas detected by the air-fuel ratio sensor 126, and correction values including a sensor response delay in the exhaust temperature sensor 140 and a transient response delay in the exhaust converting catalyst 127. In FIG. 1, a muffler 129 is also depicted.

A crank angle sensor 131 is provided for a crankshaft 130 of the engine EG. The engine control unit 11 detects an engine rotation speed Ne by counting a crank unit angle signal that is outputted from the crank angle sensor 131 in synchronization with engine rotation for a certain time, or by measuring the cycle of a crank reference angle signal.

A water temperature sensor 133 is disposed protruding into a cooling jacket 132 of the engine EG. The water temperature sensor 133 detects a cooling water temperature Tw inside the cooling jacket 132 and outputs a detection signal to the engine control unit 11.

As described above, the detection signals from the various sensors 113, 117, 126, 128, 131, 133, and 140 are inputted to the engine control unit 11 that includes a microcomputer including a CPU, a ROM, a RAM, an A/D converter, and an input/output interface. The engine control unit 11, depending on an operation state detected based on the signals from the sensors, controls the position of the throttle valve 114 and also controls a fuel injection amount and a fuel injection timing by driving the fuel injection valve 118.

Figure 3:
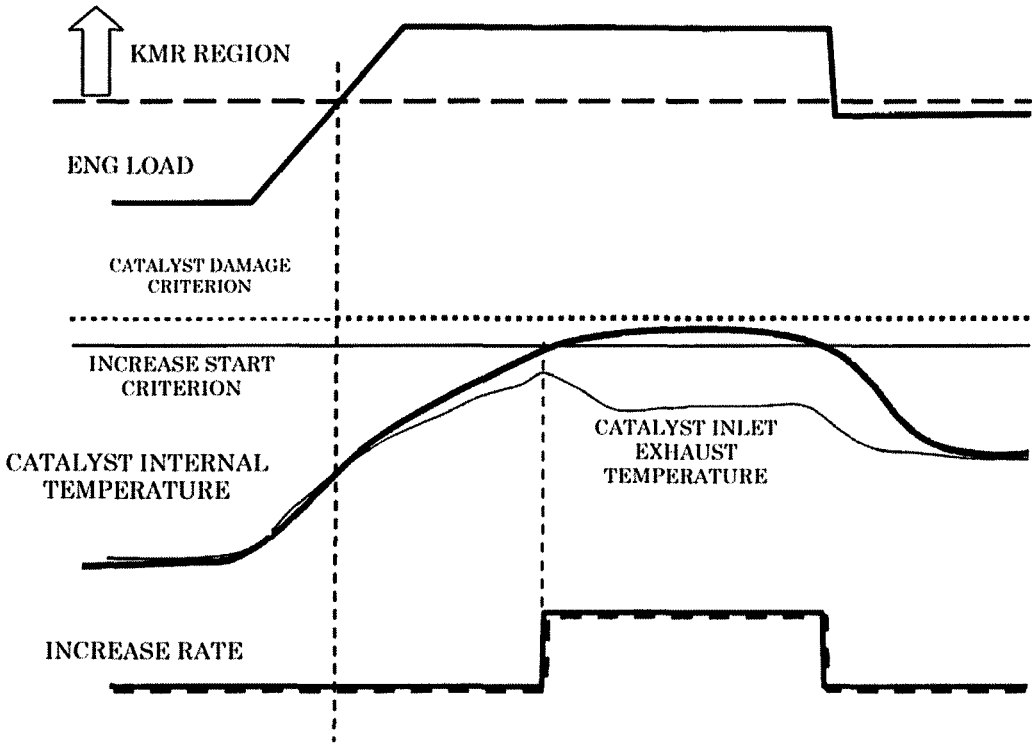
FIG. 3 is a time chart illustrating basic chronological control parameters of the fuel injection control of FIG. 2.

Further, the catalyst bed temperature of the exhaust converting catalyst 127 is estimated and, when the catalyst bed temperature reaches a predetermined upper-limit temperature, the fuel injection amount is increased so as to prevent overheating of the exhaust converting catalyst 127. FIG. 3 is an exemplary time chart of the control parameters. The time chart illustrates that, when engine load increases and the catalyst bed temperature of the exhaust converting catalyst 127 (referred to as "catalyst internal temperature" in the figure) reaches an increase start criterion, control for increasing the amount of fuel injection from the fuel injection valve 118 is started, and the increasing control is continued until the estimated catalyst bed temperature is equal to or lower than the increase start criterion.

Upon a fuel cut control or a rapid decrease in the intake air amount, the fuel adhering to the wall surfaces of the fuel injection port 111*a* of the intake passage may flow into the exhaust converting catalyst 127 (wall flow) in an unburned state. The amount of the wall flow varies depending on the fuel injection amount immediately before the fuel cut control or the rapid decrease in intake air amount. As a result, the accuracy of estimation of the catalyst bed temperature decreases. In other words, when the wall flow amount is large, the amount of unburned fuel HC that enters the exhaust converting catalyst 127 increases and the heat of reaction between HC and the catalyst increases, resulting in a higher actual temperature than a normal estimated temperature.

Figure 5A:
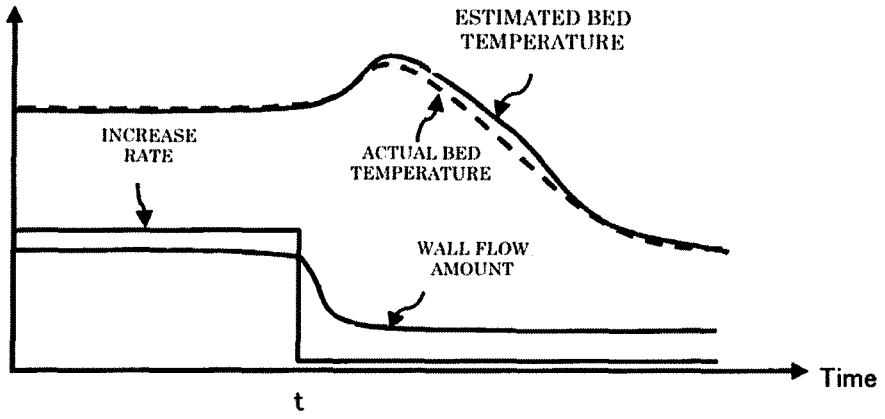
FIG. 5A is a graph of estimated bed temperature and other factors in a case where wall flow amount correction is performed upon fuel cut.
Figure 5B:
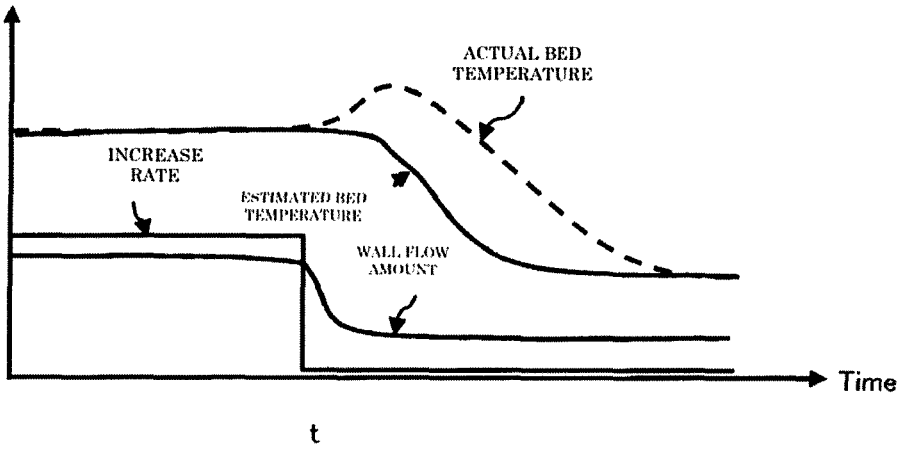
FIG. 5B is a graph of estimated bed temperature and other factors in a case where wall flow amount correction is not performed upon fuel cut.
Figure 6A:
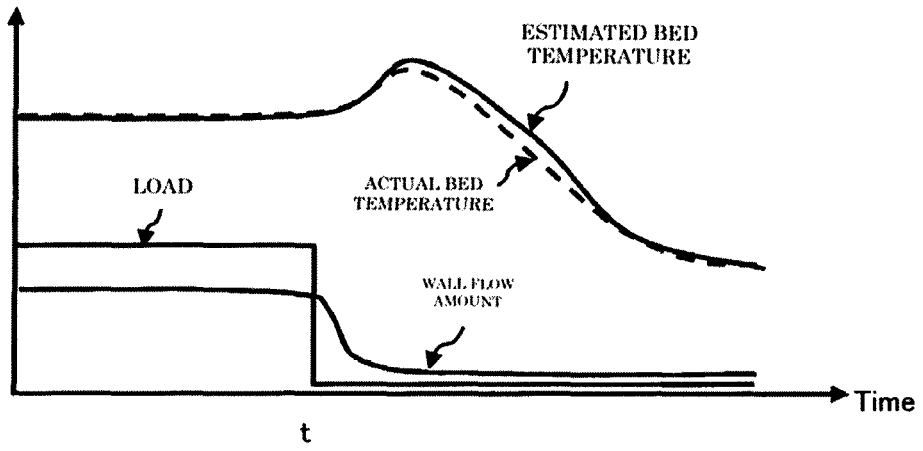
FIG. 6A is a graph of estimated bed temperature and other factors in a case where wall flow amount correction is performed upon engine load (intake air amount) decrease.
Figure 6B:
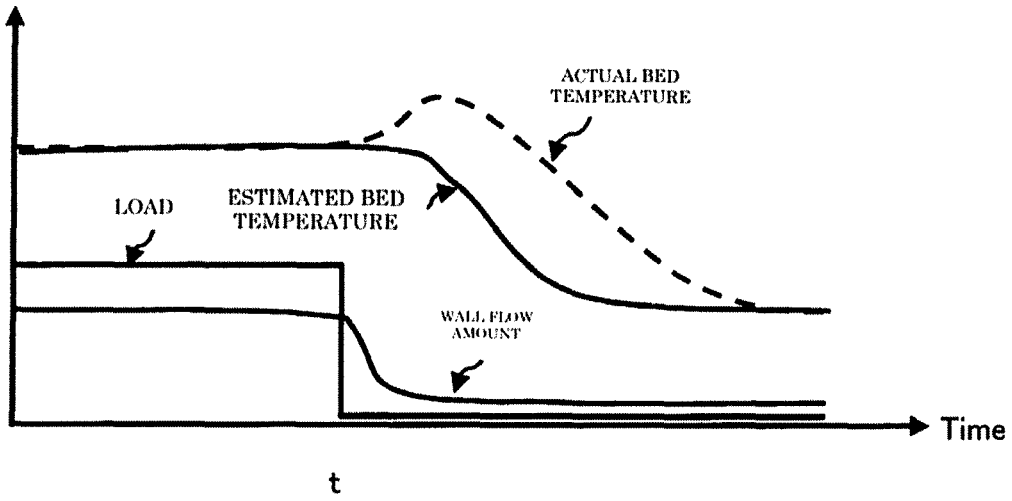
FIG. 6B is a graph of estimated bed temperature and other factors in a case where wall flow amount correction is not performed upon engine load (intake air amount) decrease.

FIGS. 5B and 6B depict the above phenomenon. As in FIG. 5B, as the fuel injection amount is increased due to, for example, an increase in engine load, the wall flow amount also increases. When fuel cut is effected at time t, the fuel adhering to the wall surfaces of the fuel injection port 111*a* flows into the exhaust converting catalyst 127 via the combustion chamber 123 (as indicated by the decrease in wall flow amount in FIG. 5B that lags the cutoff in the rate of fuel supplied by the injector 118), resulting in a higher actual catalyst bed temperature than the estimated temperature because of the heat of reaction or the wall flow fuel.

Similarly, as in FIG. 6B, when the engine load increases, the fuel injection amount is increased, resulting in an increase in wall flow amount. When the load decreases rapidly and the intake air amount is decreased rapidly at time t, the fuel adhering to the wall surfaces of the fuel injection port 111*a* flows into the exhaust converting catalyst 127 via the combustion chamber 123 (as indicated by the decrease in wall flow amount in FIG. 6B that lags the decrease in load), resulting in a higher actual catalyst bed temperature than the estimated temperature because of the heat of reaction.

The wall flow amount during the injection of fuel is determined by calculating the difference between the fuel injection amount from the fuel injection valve 118 and a fuel consumption amount. The fuel consumption amount is determined based on, for example, the output of the air-fuel ratio sensor 126 and the intake air amount according to the airflow meter 113. The wall flow amount during the ceasing of fuel injection is determined by, for example, using a map of boost and vaporization ratio at different water temperatures. For example, the wall flow amount during the ceasing of fuel injection can be calculated as the previous wall flow amount multiplied by (1−the wall flow vaporization ratio).

Figure 2:
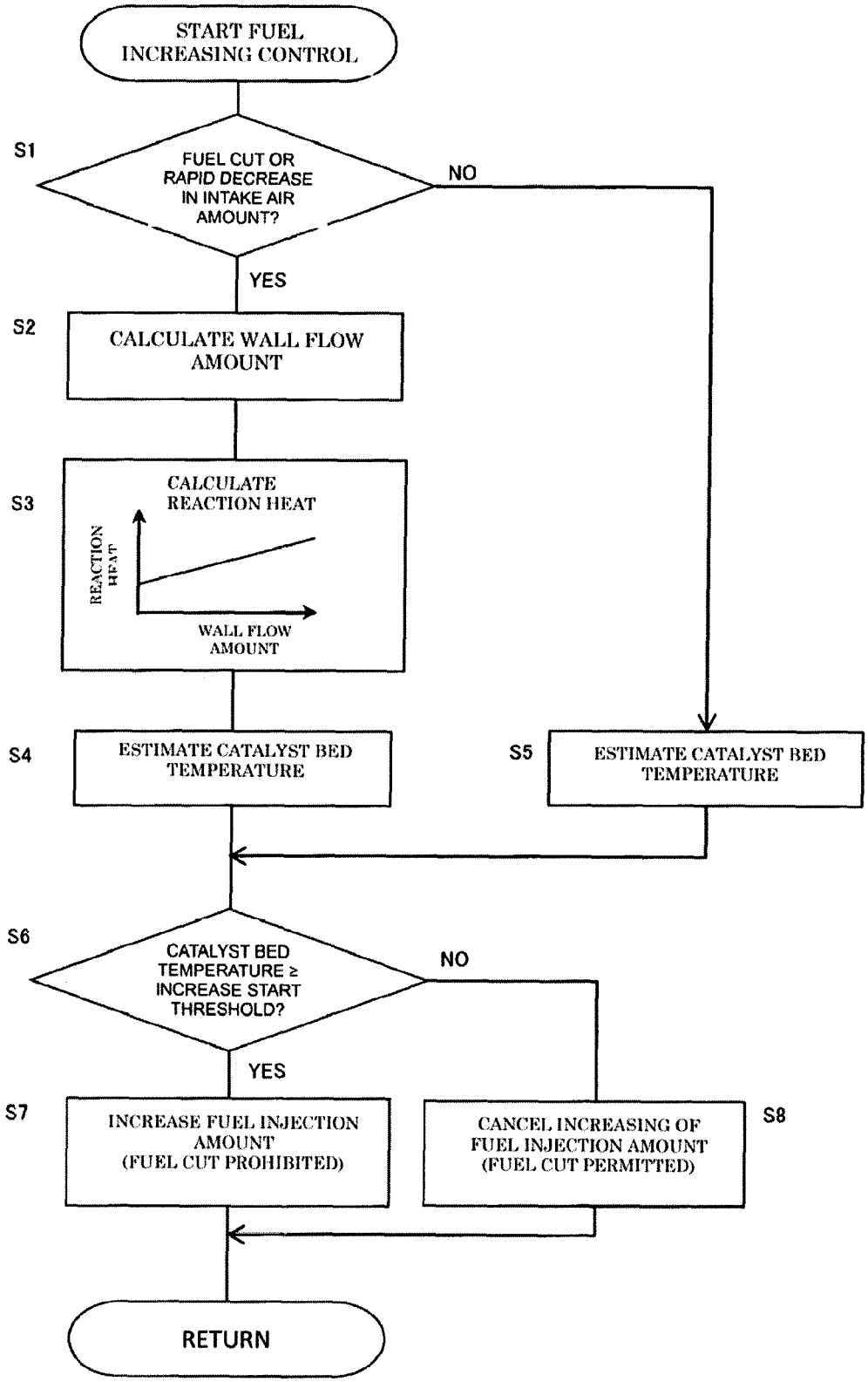
FIG. 2 is a flowchart of an exemplary fuel injection control by an engine control unit as in FIG. 1.

In the following, a fuel injection amount control process in which the wall flow amount of the fuel injection port 111*a* is considered according to the present example is described with reference to FIG. 2.

In the fuel injection amount increasing control for preventing the overheating of the exhaust converting catalyst 127, first in step S1, it is determined whether a fuel cut control has been performed or an intake air amount has been rapidly decreased. The fuel cut control is effected, for example, when the engine load is zero and the engine rotation speed is equal to or more than a predetermined value, and can be known based on information from the engine control unit 11. The decrease in intake air amount can be known based on a detection signal from the airflow meter 113. As to the decrease in intake air amount, a detection signal from an accelerator position sensor may be substituted.

When a fuel cut control or a rapid decrease in intake air amount is not detected in step S1, the process proceeds to step S5 in which the catalyst bed temperature of the exhaust converting catalyst 127 is estimated according to the predetermined calculation expression set in the engine control unit 11, based on the inlet temperature detected by the exhaust temperature sensor 140, the catalyst reaction heat according to the air-fuel ratio in the exhaust gas detected by the air-fuel ratio sensor 126, and correction values including the sensor response delay in the exhaust temperature sensor 140 and the transient response delay in the exhaust converting catalyst 127.

When a fuel cut control or a rapid decrease in intake air amount is detected in step S1, the process goes to step S2 where the wall flow amount of fuel adhering to the wall surfaces of the fuel injection port 111*a* is calculated. Specifically, the wall flow amount immediately before the fuel cut or the rapid decrease in intake air amount is calculated. As described above, the wall flow amount during fuel injection is determined by calculating the difference between the fuel injection amount from the fuel injection valve 118 and the fuel consumption amount. The fuel consumption amount is determined based on the output from the air-fuel ratio sensor 126 and the intake air amount according to the airflow meter 113.

In step S3, the reaction heat due to the wall flow amount is calculated by using the wall flow amount determined in step S2 and a control map in which the relationship between the wall flow amount and reaction heat are mapped; the mapping data between wall flow amount and reaction heat are determined experimentally or by simulation. In step S4, the catalyst bed temperature of the exhaust converting catalyst 127 is estimated according to the predetermined calculation expression set in the engine control unit 11 based on the catalyst inlet temperature detected by the exhaust temperature sensor 140, the catalyst reaction heat according to the air-fuel ratio in the exhaust gas detected by the air-fuel ratio sensor 126, and the correction values including the sensor response delay in the exhaust temperature sensor 140 and the transient response delay in the exhaust converting catalyst 127, also in consideration of the reaction heat determined in step S3.

In step S6, it is determined whether the catalyst bed temperature estimated in step S4 or S5 is equal to or greater than a preset increase start threshold (corresponding to the "increase start criterion" in FIG. 3). When the estimated catalyst bed temperature is equal to or greater than the increase start threshold, the fuel injection amount is increased by a predetermined amount in step S7. If the fuel cut condition is satisfied when the process proceeds to step S7, fuel cut is prohibited. When the estimated catalyst bed temperature is lower than the increase start threshold, the fuel injection amount is not increased in step S8. Thus, in the case where the wall flow amount is such that the estimated catalyst bed temperature exceeds the threshold (i.e., in the case where the wall flow amount exceeds a predetermined value), the fuel injection amount is corrected to be increased, or the fuel injection amount is corrected to be increased while a fuel cut is prohibited.

After the estimated catalyst bed temperature is determined to be equal to or greater than the increase start threshold and the fuel injection amount is increased in step S7, the process returns to step S1, and the increasing control is continued until the estimated catalyst bed temperature is lower than the increase start threshold in step S6. When the estimated catalyst bed temperature is lower than the increase start threshold, the increasing of the fuel injection amount is cancelled in step S8. When the fuel cut is prohibited in step S7, the process eventually (after first increasing the fuel injection amount) proceeds to step S8 where the fuel cut is permitted after the catalyst bed temperature is sufficiently decreased by increasing the fuel.

Figure 4:
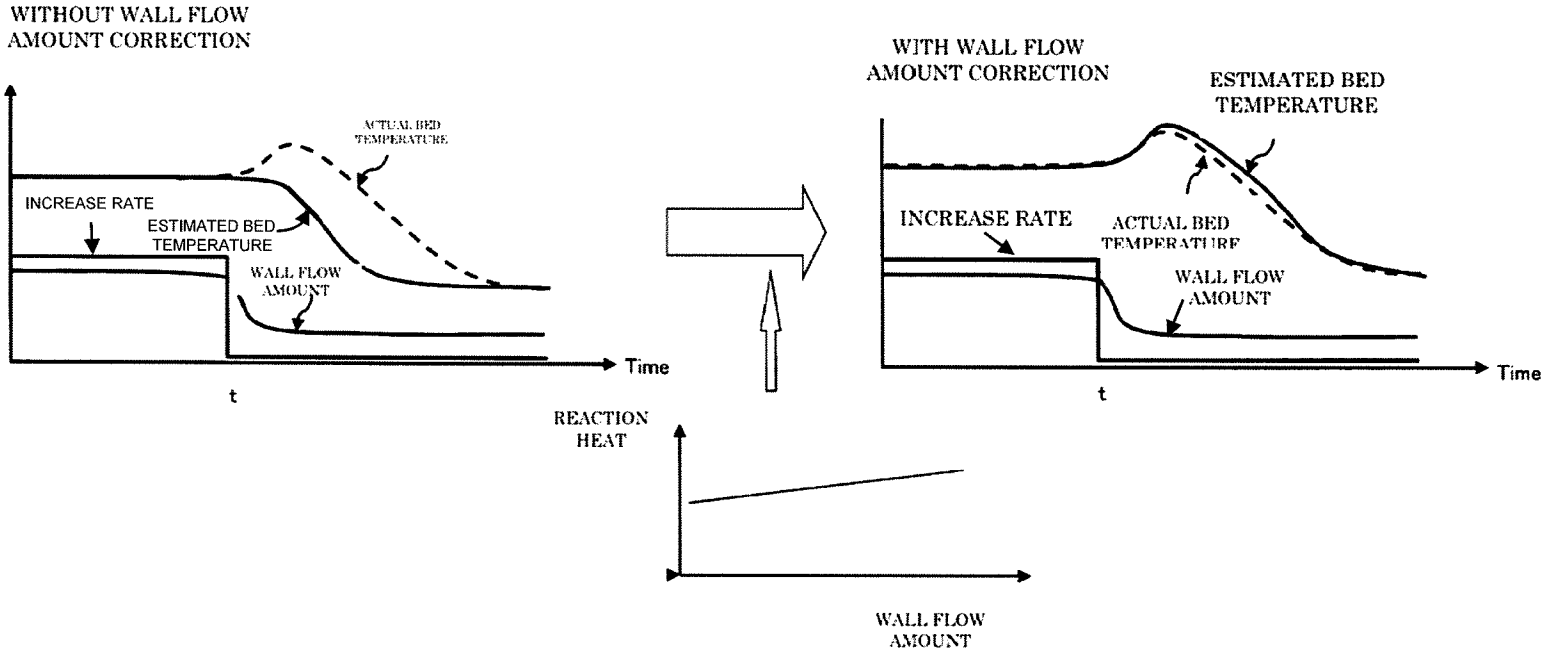
FIG. 4 is an explanatory graph of the parameters of a wall flow amount control.

Thus, in accordance with the fuel injection amount increasing control according to the present example, as depicted in FIGS. 4 and 5A, when a fuel cut is effected at time t, the catalyst bed temperature is estimated by taking into consideration the reaction heat due to the wall flow amount of the fuel adhering to the wall surfaces of the fuel injection port 111*a*. Accordingly, the actual catalyst bed temperature can be approximated even when the wall flow amount is increased immediately before the fuel cut due to an increase in the fuel injection amount which may be caused by an increase in engine load. In this way, overheating of the exhaust converting catalyst 127 is preventable. In addition, the increase in fuel injection amount can be suppressed to the extent that the estimation accuracy can be increased, resulting in an improvement in gas mileage.

In the present example, the estimated value of the catalyst bed temperature is corrected depending on the wall flow amount. In other words, fuel increase is effected at the time of fuel cut control or rapid decrease in intake air amount by considering the wall flow amount of the fuel injection port. Thus, features or structures may be adopted such that, without estimating the catalyst bed temperature, the fuel injection amount is corrected to be increased when the wall flow amount exceeds a predetermined value upon sharp decrease in intake air amount, or the fuel injection amount is corrected to be increased while fuel cut is prohibited when the wall flow amount exceeds the predetermined value upon satisfying the predetermined fuel cut condition.

While, in the foregoing embodiment, the wall flow amount of the fuel injection port 111*a* is determined by calculating the difference between the fuel injection amount and the fuel consumption amount (step S2 in FIG. 2), the wall flow amount may also be corrected by various types of engine control as described below.

Figure 7:
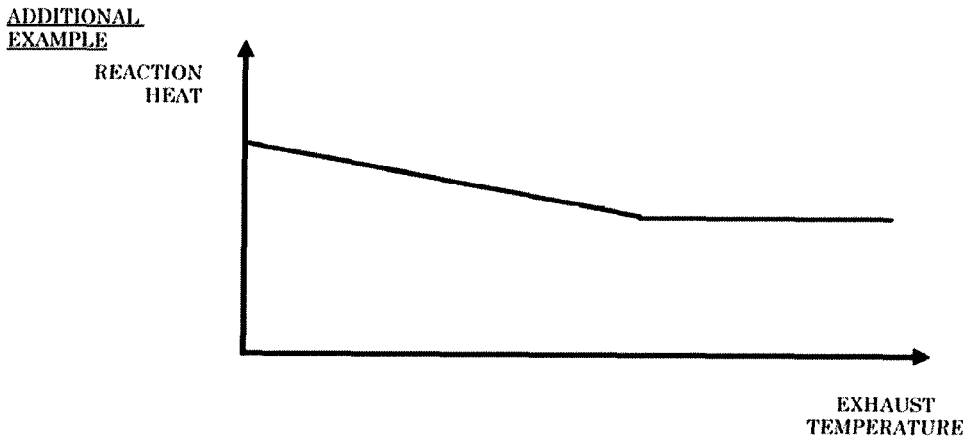
FIG. 7 is a control map according to another embodiment of the present invention.

FIG. 7 depicts an embodiment that is based on the realization that the catalyst reaction heat to be caused by the flow of the wall flow fuel into the catalyst upon sharp decrease in intake air amount or satisfying of the fuel cut condition varies depending on the exhaust temperature immediately before the sharp decrease in intake air amount or the satisfying of the fuel cut condition. Specifically, the amount of fuel increase is corrected based on the exhaust temperature immediately before the rapid decrease in intake air amount (or fuel cut) is detected. Although the cause of the phenomenon is yet to be fully understood, the reaction heat increases and the catalyst bed temperature becomes higher for the same wall flow amount (i.e., when the amount of fuel that flows into the catalyst is the same) as the exhaust temperature becomes lower. Thus, the estimated catalyst temperature is corrected to be higher or the correction amount for increasing the fuel injection amount is corrected to be increased as the exhaust temperature becomes lower. In this way, the accuracy of estimation of the catalyst bed temperature is improved regardless of the exhaust temperature. The exhaust temperature is detectable by the exhaust temperature sensor 140.

Figure 8:
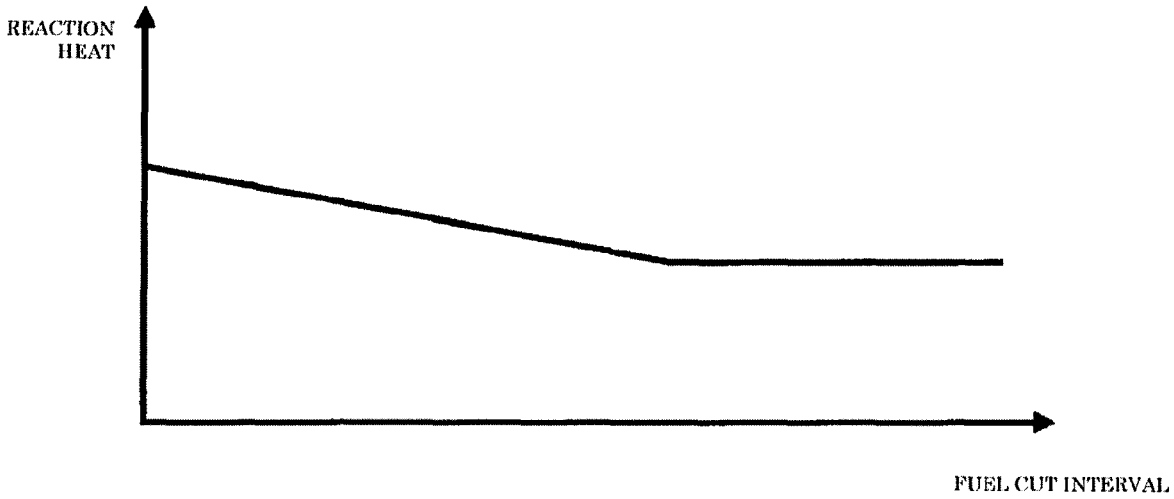
FIG. 8 is a control map according to yet another embodiment of the present invention.

FIG. 8 depicts an embodiment that takes into consideration a fuel injection amount increasing control that is performed for recovery from the cutting of fuel by the fuel cut control. Specifically, the wall flow amount is corrected depending on the time interval (fuel cut interval) between a fuel cut immediately before detection of the rapid decrease in intake air amount and the next fuel cut. When the fuel cut interval is short, the amount of increase in fuel injection amount for recovery after fuel cut is increased, resulting in an increase in wall flow amount. Thus, the shorter the fuel cut interval, the greater the amount of reaction heat. Accordingly, the wall flow amount is estimated (corrected) more generously as the fuel cut interval becomes shorter so that the correction amount for increasing the fuel injection amount can be increased. In this way, the catalyst bed temperature is prevented from becoming excessively high regardless of the time interval for fuel cut.

Figure 9:
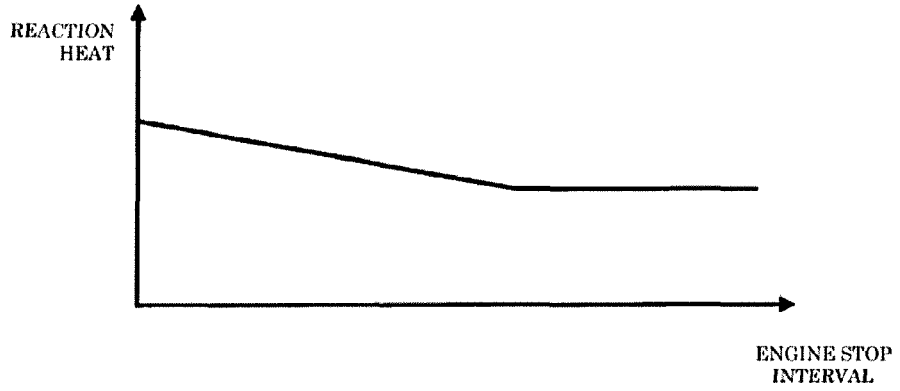
FIG. 9 is a control map according to yet another embodiment of the present invention.

FIG. 9 depicts an embodiment for hybrid vehicles, for example, in which an electric motor and an internal combustion engine are provided as a vehicle drive source, where the internal combustion engine is temporarily stopped depending on vehicle running conditions. When the internal combustion engine is restarted during the running of the vehicle, the fuel injection amount is controlled to be increased, such that the wall flow amount increases when the engine stop interval is short. Therefore, the shorter the engine stop interval, the greater the amount of reaction heat becomes. Thus, the wall flow amount is estimated (corrected) more generously as the engine stop interval becomes shorter, so as to increase the correction amount for increasing the fuel injection amount. In this way, the catalyst bed temperature is prevented from becoming excessively high regardless of the engine stop interval.

Figure 10:
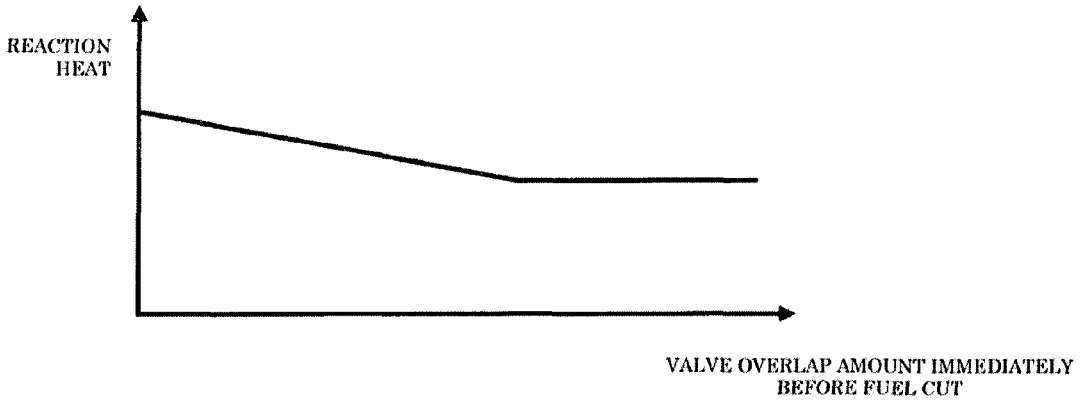
FIG. 10 is a control map according to yet another embodiment of the present invention.

FIG. 10 depicts an embodiment directed to an internal combustion engine, for example, which is capable of controlling the open/close timings of the intake valve 121 and the exhaust valve 122. During a valve overlap period in which both the intake valve 121 and the exhaust valve 122 are open, combustion gas may enter the intake passage 111 and cause the fuel adhering to the wall surfaces of the fuel injection port 111*a* to evaporate. The greater the valve overlap amount, the smaller the wall flow amount becomes, and the smaller the valve overlap amount, the greater the wall flow amount becomes. Thus, the amount of reaction heat increases as the valve overlap amount immediately before fuel cut or the rapid decrease in intake air amount is decreased. Accordingly, the wall flow amount is estimated (corrected) more generously as the valve overlap amount decreases, so as to increase the correction amount for increasing the fuel injection amount. In this way, the catalyst bed temperature is prevented from becoming excessively high regardless of the valve overlap amount.

Figure 11:
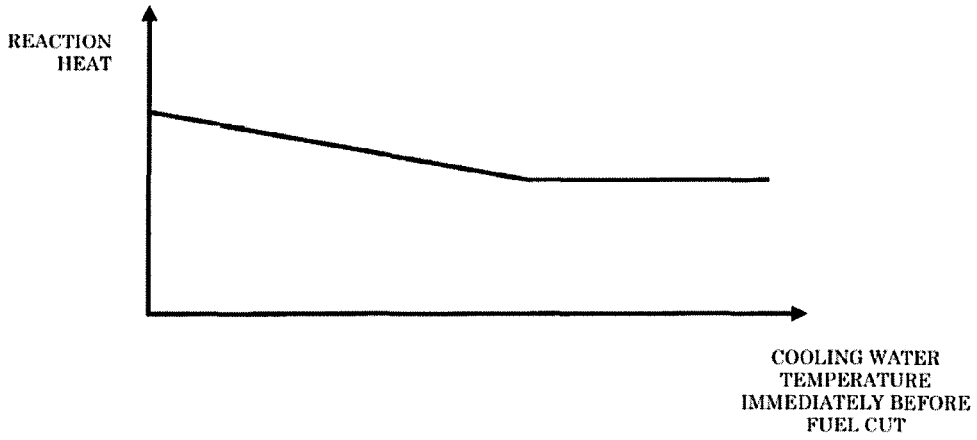
FIG. 11 is a control map according to yet another embodiment of the present invention.

FIG. 11 depicts an embodiment in which the temperature of the engine cooling water detected by the water temperature sensor 133 is taken into consideration. The higher the temperature of the engine cooling water, the more of the fuel adhering to the wall surfaces of the fuel injection port 111*a* is evaporated and the smaller the wall flow amount becomes. The lower the engine cooling water, the greater the wall flow amount becomes. Therefore, the amount of reaction heat increases as the temperature of the engine cooling water immediately before fuel cut or the rapid decrease in intake air amount becomes lower. Thus, the wall flow amount is estimated (corrected) more generously as the temperature of the engine cooling water decreases, so as to increase the correction amount for increasing the fuel injection amount. In this way, the catalyst bed temperature is prevented from becoming excessively high regardless of the water temperature of the engine cooling water.

The engine control unit 11, the air-fuel ratio sensor 126, and the exhaust temperature sensor 140 corresponds to catalyst temperature estimating means according to embodiments of the present invention. The engine control unit 11 corresponds to control means, fuel cut interval detecting means, engine stop interval detecting means, valve overlap amount detecting means, and wall flow amount estimating means according to embodiments of the present invention. The water temperature sensor 133 corresponds to cooling water temperature detecting means according to embodiments of the present invention.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel injection control apparatus for controlling an amount of fuel injection into a fuel injection port of an intake passage in an internal combustion engine, the fuel injection control apparatus comprising:

an exhaust air-fuel ratio sensor configured to detect an exhaust air-fuel ratio;

an exhaust temperature sensor configured to detect an exhaust temperature;

an intake air flow meter configured to detect an intake air amount in the intake passage; and a controller configured to:

detect a fuel cut or a rapid decrease in intake air amount;

estimate a wall flow amount of the fuel injection port based on the fuel injection amount immediately before the fuel cut or the rapid decrease in intake air amount, the detected exhaust air-fuel ratio, and the detected intake air amount;

estimate a catalyst bed temperature of a catalyst provided in an exhaust passage based on the detected exhaust air-fuel ratio and the detected exhaust temperature and to correct the estimated catalyst bed temperature in accordance with the wall flow amount; and control the fuel injection amount based on the catalyst bed temperature.

2. The fuel injection control apparatus for an internal combustion engine according to claim 1, wherein the controller is configured to correct the estimated catalyst bed temperature to be higher as the exhaust temperature is decreased.

3. The fuel injection control apparatus according to claim 1, wherein the exhaust temperature sensor is configured to detect an exhaust temperature upstream of the catalyst in the exhaust passage;

wherein the air-fuel ratio sensor is configured to detect an exhaust gas air-fuel ratio upstream of the catalyst in the exhaust passage; and wherein the controller is configured to estimate the catalyst bed temperature based on the detected exhaust temperature and the detected exhaust air-fuel ratio.

4. The fuel injection control apparatus according to claim 3, wherein the controller is further configured to account for a sensor response delay of the exhaust temperature sensor and a transient response delay of the catalyst when estimating the catalyst bed temperature.

5. The fuel injection control apparatus according to claim 1, wherein the controller is configured to estimate the wall flow amount of the fuel injection port based on the difference between the fuel injection amount and a fuel consumption amount.

6. The fuel injection control apparatus according to claim 1, wherein the air-fuel ratio sensor is configured to detect an exhaust gas air-fuel ratio upstream of the catalyst in the exhaust passage; and wherein the controller is configured to estimate the fuel consumption amount based on the detected intake air amount and the detected exhaust gas air-fuel ratio.

7. The fuel injection control apparatus according to claim 1, wherein the controller is further configured to detect a fuel cut interval for fuel cut control and to correct the wall flow amount in accordance with a detected fuel cut interval.

8. The fuel injection control apparatus according to claim 1, wherein the controller is further configured to detect an interval in which the internal combustion engine is temporarily stopped and to correct the wall flow amount in accordance with a detected engine stop interval.

9. The fuel injection control apparatus according to claim 1, wherein the controller is further configured to detect a valve overlap amount immediately before a fuel cut in fuel cut control and to correct the wall flow amount in accordance with a detected valve overlap amount.

10. The fuel injection control apparatus according to claim 1, further comprising:

a cooling water temperature sensor configured to detect a cooling water temperature of the internal combustion engine;

wherein the controller is configured to correct the wall flow amount in accordance with the detected cooling water temperature.

11. A fuel injection control apparatus for controlling an amount of fuel injection into a fuel injection port of an intake passage in an internal combustion engine, the fuel injection control apparatus comprising:

an exhaust air-fuel ratio sensor configured to detect an exhaust air-fuel ratio;

an intake air flow meter configured to detect an intake air amount in the intake passage; and a controller configured to:

estimate a wall flow amount of the fuel injection port based on the fuel injection amount, the detected exhaust air-fuel ratio, and the detected intake air amount; and correct the fuel injection amount to be increased when the wall flow amount is larger than a predetermined value upon sharp decrease in an intake air amount.

12. The fuel injection control apparatus according to claim 11, further comprising:

an exhaust temperature sensor configured to detect an exhaust temperature;

wherein the controller is further configured to:

estimate a catalyst bed temperature of a catalyst provided in an exhaust passage in accordance with the wall flow amount; and control the fuel injection amount based on the catalyst bed temperature.

13. The fuel injection control apparatus according to claim 11, further comprising:

an exhaust temperature sensor configured to detect an exhaust temperature;

wherein the controller is configured to correct a correction amount for increasing the fuel injection amount to be increased as the exhaust temperature is decreased.

14. A fuel injection control apparatus for controlling an amount of fuel injection into a fuel injection port of an intake passage in an internal combustion engine, the fuel injection control apparatus comprising:

an exhaust air-fuel ratio sensor configured to detect an exhaust air-fuel ratio;

an intake air flow meter configured to detect an intake air amount in the intake passage; and a controller configured to:

estimate a wall flow amount of the fuel injection port based on the fuel injection amount, the detected exhaust air-fuel ratio, and the detected intake air amount; and prohibit a fuel cut and correct the fuel injection amount to be increased when the wall flow amount is larger than a predetermined value upon satisfaction of a predetermined fuel cut condition.

* * * * *